US005150547A

United States Patent [19]

Johnson

[11] Patent Number: 5,150,547

[45] Date of Patent: Sep. 29, 1992

[54] OPHTHALMIC LENS PRISM BLOCKING RING

[76] Inventor: David O. Johnson, 2104 Shenandoah Rd., Raleigh, N.C. 27603

[21] Appl. No.: 695,929

[22] Filed: May 6, 1991

[51] Int. Cl.[5] ..... B24B 41/06

[52] U.S. Cl. ..... 51/216 LP; 51/216 A; 51/237 R

[58] Field of Search ..... 51/216 R, 216 LP, 216 A, 51/236, 237 R, 105 LG, 106 LG, 124 L, 125, 129, 131.1, 131.3

[56] References Cited

U.S. PATENT DOCUMENTS 3,049,766 8/1962 Buckminster ..... 164/4.1
3,195,197 7/1965 Prunier ..... 425/173
3,866,667 2/1975 Knight ..... 51/216 LP

*Primary Examiner*—J. J. Swann
*Assistant Examiner*—Eileen Morgan
*Attorney, Agent, or Firm*—Rosenthal & Putterman

[57] ABSTRACT

A set of ophthalmic lens prism blocking rings is disclosed wherein each prism blocking ring comprises a substantially circular annulus adapted to be detachably connected between an ophthalmic lens to be ground and a blocking body. The annulus has a flat lower annular surface and a first thickness at one end of a diameter and a second thickness at the other end of the diameter and defines an inclined plane therebetween. The angle of incline corresponds to the amount of prism to be introduced into the lens.

2 Claims, 3 Drawing Sheets

OPHTHALMIC LENS PRISM BLOCKING RING

FIELD OF THE INVENTION

This invention relates generally to the field of blocking of lens blanks and, more particularly, to an apparatus for presenting the lens at the proper angle to the grinding wheel for the introduction of a prism correction.

BACKGROUND OF THE INVENTION

Ophthalmic or eyeglass lens blanks are subjected to a variety of grinding and polishing steps in order to create a finished eyeglass lens. During these processing steps the lens is shaped to the proper curvature, thickness and prism. Prior to processing, the lens is circular, of a particular thickness and opposite sides are parallel. To obtain the proper optical effects in order to correct a patient's vision, the opposite surfaces are shaped so that one surface is concave and the other surface is convex. In addition, a prism correction is also frequently needed. The prism correction is obtained by altering the parallel nature of the lens blank and grinding one surface to create an angle between the other surface. Thus, a lens blank that includes a prism correction or component is thicker at one end of its diameter then at the opposite end.

The problem of obtaining the precise alignment between the opposite surfaces has been attacked in a variety of ways. In one such solution the lens blank is attached to the lens blocking body in the conventional manner using pitch or another acceptable adhesive. Then, the back side of the lens blocking body is attached to the grinding machine chuck, also in the conventional manner, however, a shim is inserted therebetween to present the lens at the desired angle to the grinding wheel.

Another apparatus for introducing prism into lenses is disclosed in Cradlock U.S. Pat. No. 3,273,204. A mold for the manufacture of lenses is disclosed and includes two opposing housings, each having a bore that receives a lens molding die. One of the axes of the bore is offset in relation to the common axis and one of the dies is retractable within its housing to obtain the desired amount of prism.

The foregoing devices are generally effective for fabricating lenses having low (generally considered less than 4 diopters) corrections, however, lenses having a correction greater than 4 diopters are difficult to manufacture and require great skill to obtain satisfactory results.

Another apparatus for generating a lens having a prism is disclosed in Knight U.S. Pat. No. 3,866,667. Specifically, the patent teaches a blocking device in which a pair of wedge-shaped prism rings may be adjusted relative to each other and relative to the bore of the device for incorporating into the lens block a predetermined amount of prism at a predetermined meridional orientation. Graduations, measured in diopters are marked on the rings. In this system, the entire blocking body is molded and is generally effective in inducing large amounts of prism. However, the Knight device was designed for use with glass lens blanks and when used with plastic lenses, warpage occurs as the device retains too much heat.

It would, therefore, be advantageous to industry and to optical laboratories in particular, to be able to reliably produce ophthalmic spectacle lenses having a high prism correction.

SUMMARY OF THE INVENTION

In accordance with the present invention, there is provided an ophthalmic prism lens blocking ring for holding a spectacle lens during grinding to introduce a prism correction therein. The prism blocking ring takes the shape of a substantially circular annulus adapted to be detachably connected between an ophthalmic lens to be ground and a blocking body. The annulus has a flat lower annular surface and has a first thickness at the first end of a diameter and a second thickness at the opposite end of the diameter and wherein an inclined plane is defined therebetween. The angle of incline defines the amount of prism that will be introduced into the lens upon the completion of grinding.

BRIEF DESCRIPTION OF THE DRAWINGS

Some of the objects of the invention having been stated, other objects will appear as the description proceeds when taken in connection with the accompanying drawings in which—

DETAILED DESCRIPTION OF THE PREFERRED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
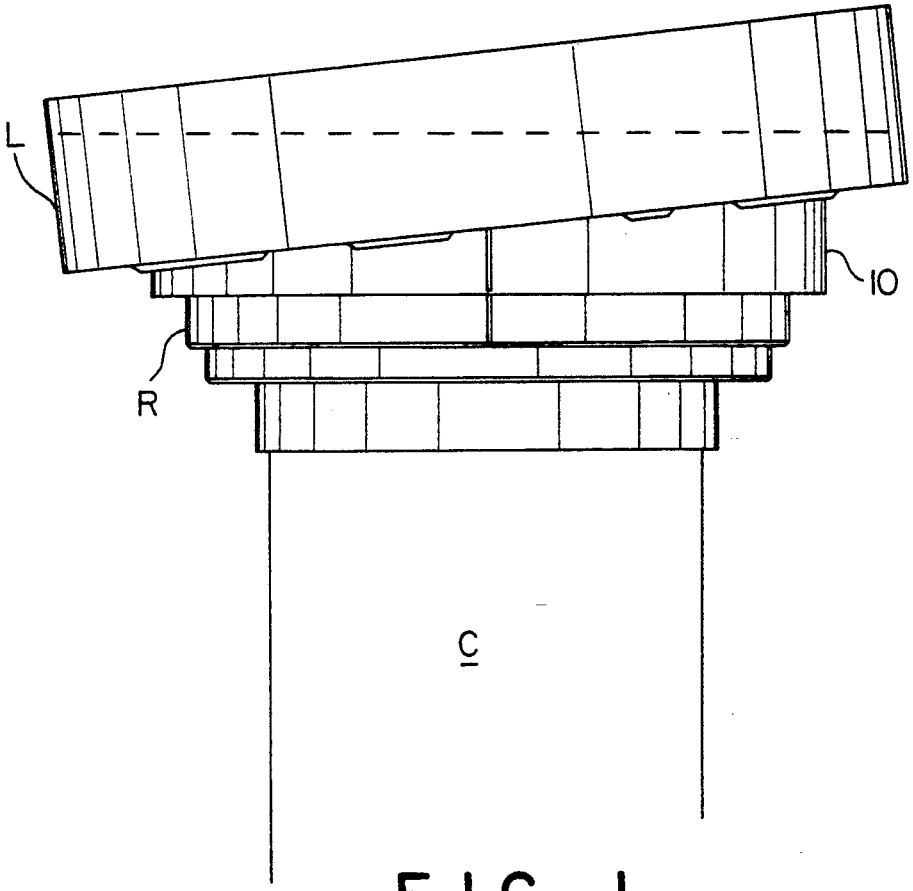
FIG. 1 is a side view of the ophthalmic lens prism blocking ring mounted between a lens and a blocking body according to the present invention.
Figure 3:
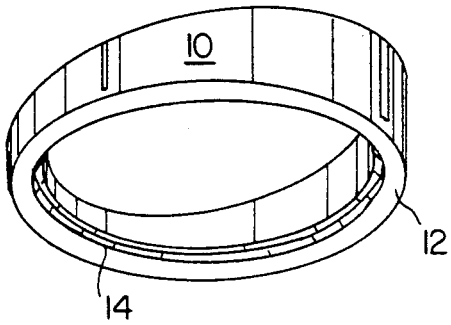
FIG. 3 is a perspective view, taken from below, of the ophthalmic lens prism blocking ring according to the present invention.
Figure 2:
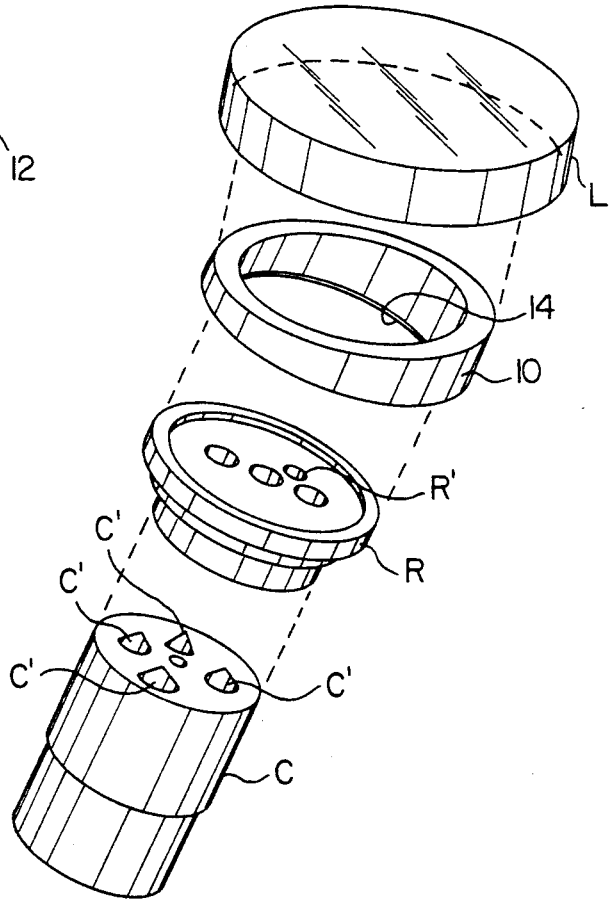
FIG. 2 is an exploded view, taken in perspective, of the ophthalmic lens prism blocking ring of the present invention mounted between a lens and a blocking body and wherein the blocking body is mounted to a chuck.

Referring now to the drawings, the ophthalmic lens prism blocking ring generally indicated at 10 is there illustrated. The ring 10 is adapted to be used in conjunction with existing lens processing equipment such as is usually found in processing laboratories. Accordingly, there is provided a cylindrical metal chuck C including mounting and alignment protuberances C'. A cylindrical metal blocking body R includes a bore R' into which the alloy is injected and on its underside are depressions adapted to receive protuberances C' (not shown) and a witness or alignment mark W (FIG. 1).

The ophthalmic lens prism blocking ring 10 comprises a substantially circular annulus, of suitable plastic or metal, that as shown in the figures, is adapted to be detachably connected between the ophthalmic lens to be ground L and the blocking body R. The annulus has a flat lower annular surface 12 and a witness mark 16 for alignment with blocking body R. The annulus has a first thickness or height $h_1$ at the first end of a diameter and a second thickness or height $h_2$ at the opposite end of the diameter and defining and inclined plane therebetween. The angle of the inclined plane defines the amount of prism that will be introduced into the lens upon the completion of grinding.

The ophthalmic lens prism blocking ring also includes means for detachably connecting the ophthalmic lens to the blocking body R which takes the form of an annular recessed slot 14 that extends around the inner peripheral edge of the annulus in the lower surface thereof. The slot 14 is adapted to engage the blocking body by frictionally engaging and gripping the outer peripheral edge of the blocking body.

In operation, the optician or other lab personnel selects the ophthalmic lens prism blocking ring that corresponds to the desired amount of prism. There has not been discussed in detail the correlation between the angle of presentation of the lens to the grinding wheel and the amount of prism, as this is well known to those skilled in the art. The prism blocking ring 10 is then placed on the blocking body R, with care being taken to properly align the two components so that the witness mark at the thick side of the ring is aligned with the apex of the prism to be ground in the lens. The lens is then prepared for blocking in the usual manner and alloy is injected. It will be noted that since the space between the block and the lens is considerably greater than would normally be the case, that the alloy will require more time to cool and it might, therefore, be helpful to place the blocking body in a chiller for a short period of time. A pre-cooled block is recommended as it will cool the alloy and will help prevent the seepage of alloy between the lens and the prism blocking ring. Thus, the lens, blocking ring and blocking body are held together by a combination of friction (between the ring and blocking body) and adhesion caused by the alloy.

Figure 4:
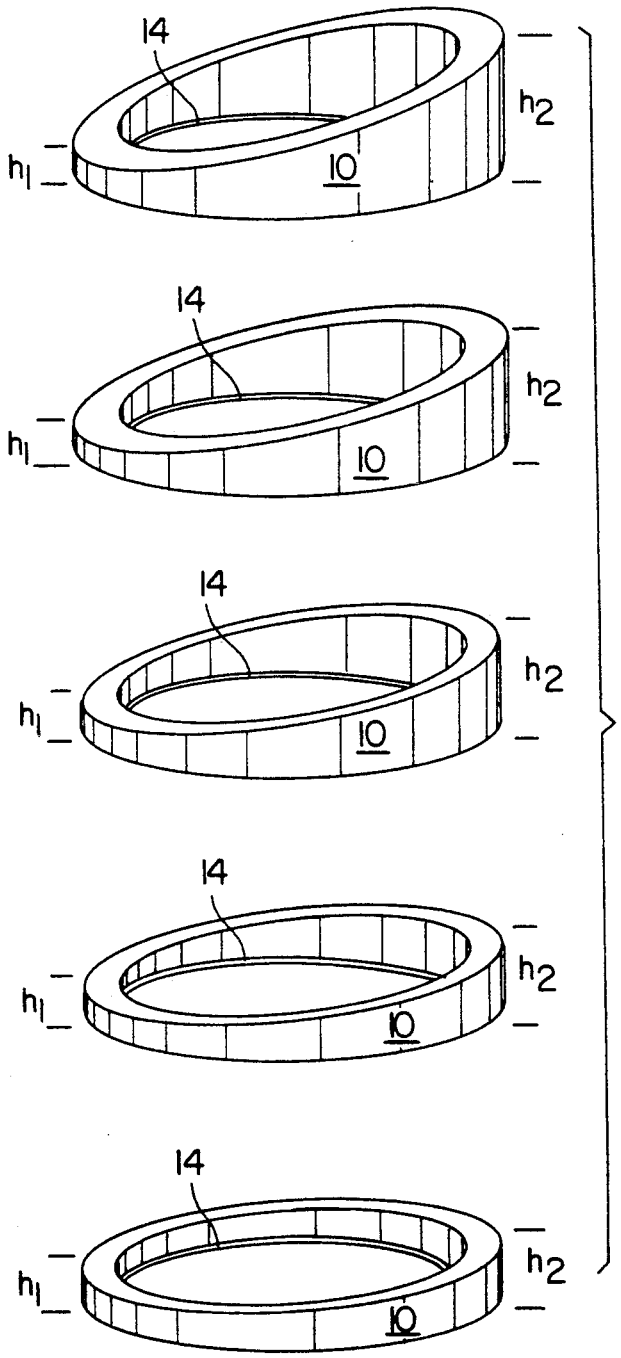
FIG. 4 is a perspective view of a number of ophthalmic lens prism blocking rings according to the present invention, each having a different angle of incline corresponding to the number of diopters of prism correction that will be ground into the lens.

It is contemplated that the prism blocking ring 10 according to the present invention will be supplied as part of a set of prism rings (as shown in FIG. 4), each member of the set having a different angle of incline corresponding to a predetermined amount of prism correction. (For example, a set may run from one fourth of one to 10 diopters in increments of $\frac{1}{4}$ diopter or may be varied as needed.)

The foregoing embodiments and examples are to be considered illustrative, rather than restrictive of the invention, and those modifications which come within the meaning and range of equivalence of the claims are to be included therein.

That which is claimed is:

1. An ophthalmic lens prism blocking ring for holding a lens during grinding to introduce a prism correction therein and comprising:

a substantially circular annulus adapted to be detachably connected between an ophthalmic lens to be ground and a blocking body, said annulus having a flat lower annular surface and having a first thickness at the first end of a diameter and a second thickness at the opposite end of said diameter and defining an inclined plane therebetween, said incline defining the amount of prism that will be introduced into the lens upon the completion of grinding and further including means for detachably connecting said ophthalmic lens prism blocking ring to the blocking body comprising an annular recessed slot in the lower surface of said ophthalmic prism blocking ring, said slot adapted to frictionally engage and contact the blocking body along its entire perimeter, said slot being the sole means by which said ophthalmic lens prism blocking ring and the blocking body are connected.

2. A combination apparatus for positioning an ophthalmic lens in order to introduce a prism therein during grinding and comprising:

a blocking body having a first surface adapted to be connected to a chuck and a flat second surface; and means for positioning the ophthalmic lens at a predetermined angle on the flat second surface of said blocking body in order to introduce a predetermined amount of prism therein;

said means for positioning the ophthalmic lens comprising a set of prism blocking rings, each of said prism blocking rings being in the form of a substantially circular annulus adapted to be detachably connected to the second surface of said blocking body, said annulus having a flat lower annular surface and having a first thickness at the first end of a diameter and each member of said set having a second thickness at the opposite end of said diameter and defining an inclined plane therebetween and wherein the amount of incline in each of said prism blocking rings corresponds to the amount of prism that will be introduced into the lens upon the completion of grinding, and further including means for detachably connecting said ophthalmic lens prism blocking ring to the blocking body comprising an annular recessed slot in the lower surface of said ophthalmic prism blocking ring, said slot adapted to frictionally engage and contact the blocking body along its entire perimeter, said slot being the sole means by which the ophthalmic lens prism blocking ring and the blocking body are connected.

* * * * *